US007841276B2

(12) United States Patent
Eckert et al.

(10) Patent No.: US 7,841,276 B2
(45) Date of Patent: Nov. 30, 2010

(54) METHOD AND DEVICE FOR PRODUCING A PRODUCT SECTION IN A WEB PROCESSING MACHINE, AND PRODUCT SECTION

(75) Inventors: Günther Oskar Eckert, Zellingen (DE); Margit Kohl-Eckert, legal representative, Zellingen (DE); Burkard Otto Herbert, Würzburg (DE); Stefan Wander, Helmstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 12/450,081

(22) PCT Filed: May 20, 2008

(86) PCT No.: PCT/EP2008/056158

§ 371 (c)(1),
(2), (4) Date: Sep. 10, 2009

(87) PCT Pub. No.: WO2008/142069

PCT Pub. Date: Nov. 27, 2008

(65) Prior Publication Data

US 2010/0117285 A1 May 13, 2010

(30) Foreign Application Priority Data

May 21, 2007 (DE) ..... 10 2007 023 818
May 20, 2008 (DE) ..... 10 2008 001 872

(51) Int. Cl.
*B41F 13/56* (2006.01)

(52) U.S. Cl. ..... 101/227; 101/219; 101/225; 101/226; 101/228; 270/5.01; 270/21.1; 270/41

(58) Field of Classification Search ..... 101/225, 101/226, 227, 228; 270/5.01, 20.1, 21.1
See application file for complete search history.

(56) References Cited

U.S. PATENT DOCUMENTS 4,671,501 A 6/1987 Fujishiro
6,152,034 A 11/2000 Dufour
6,257,142 B1 7/2001 Baba (Continued)

FOREIGN PATENT DOCUMENTS

DE 10 2005 037 730 A1 11/2006

(Continued)

*Primary Examiner*—Ren Yan
*Assistant Examiner*—Matthew G Marini
(74) *Attorney, Agent, or Firm*—Jones, Tullar & Cooper, P.C.

(57) ABSTRACT

A product section is produced in a printing machine that has at least one former. A web or a partial web of material is guided over the former. At least one web or one partial web is initially guided over a plow fold device and then over one, or another odd number of turning bars. This at least one web or partial web is then united, without passing through the former, and on a side that has been folded in by the plow fold device, over at least one guide roller as a partial strand with a partial strand that was guided over the former as a strand bundle before this partial strand is cut transversely in a transverse cutting direction into product sections.

24 Claims, 9 Drawing Sheets

U.S. PATENT DOCUMENTS

| | | | | |
|---|---|---|---|---|
| 6,298,781 | B1 | 10/2001 | Dufour | |
| 6,422,552 | B1 | 7/2002 | Chesno et al. | |
| 6,712,749 | B1 * | 3/2004 | Michalik et al. | 493/424 |
| 2008/0257182 | A1 | 10/2008 | Eckert et al. | |

FOREIGN PATENT DOCUMENTS

| | | | |
|---|---|---|---|
| DE | 10 2005 036 451 | A1 | 2/2007 |
| EP | 0 244 761 | A2 | 11/1987 |
| EP | 1 018 427 | A1 | 7/2000 |
| EP | 1 072 551 | A2 | 1/2001 |
| EP | 1 595 837 | A1 | 11/2005 |
| WO | WO 2005/105447 | A1 | 11/2005 |

* cited by examiner

METHOD AND DEVICE FOR PRODUCING A PRODUCT SECTION IN A WEB PROCESSING MACHINE, AND PRODUCT SECTION

CROSS-REFERENCE TO RELATED APPLICATIONS

This application is the U.S. national phase, under 35 U.S.C. 371, of PCT/EP2008/056158, filed May 20, 2008; published as WO 2008/142069 A1 on Nov. 27, 2008 and claiming priority to DE 10 2007 023 818.7, filed May 21, 2007 and to DE 10 2008 001 872.4, filed May 20, 2008, the disclosures of which are expressly incorporated herein by reference.

FIELD OF THE INVENTION

The present invention is directed to methods, and to a device for producing a product section in a web-processing machine, and to the produced product sections. A product section is produced in a printing press which is provided with at least one fold former. A web, or a partial web which has been printed with printed pages having a width of a first format, is guided over the fold former. A product section is produced with a plurality of sections in tabloid format and arranged one on top of the other and having a product spine.

BACKGROUND OF THE INVENTION

A device for producing a folded product, and having two fold formers arranged one in front of another, is known from U.S. Pat. No. 4,671,501 A. The transport directions of the two fold formers, projecting into the horizontal plane, are substantially orthogonal to one another. A web, having a width of four pages, is first cut into two partial webs, each having the width of two pages. The two partial webs, each having the width of two newspaper pages, are then guided, side by side, over the two edges of the first of the two fold formers, thus causing them to be stacked one on top of another. The ribbons, which have been formed in this manner, and each having the width of two pages, are guided to the second fold former, which situated downstream, for longitudinal folding at the center.

DE 10 2005 036 451 A1 describes a device for producing a product section in a web-processing machine. The device includes a first fold former and a second fold former arranged one in front of another in a web path. The transport directions of the formers, projecting into the horizontal plane, are substantially orthogonal to one another.

WO 2005/105447 A1 describes a superstructure in one embodiment of a web-fed printing press. A printed web ribbon is folded in on one side or on both sides by a plough folding apparatus, and the folded ribbon is then guided to a fold former for longitudinal folding. One partial web is printed with a first format and another partial web is printed with a second, wider format. The second partial web is ultimately combined with the first partial web. After it has been folded by a plough folding apparatus, the second, wider partial web is guided, together with the other partial web or webs, over the fold former.

In EP 1 595 837 A1 in one operating mode, a web is guided to a fold former which corresponds to the width of the web. In another operating mode, one partial ribbon of the web is guided to the former, which has been moved laterally.

Another partial ribbon is guided to a turning bar which has the same orientation as a former edge.

SUMMARY OF THE INVENTION

The object of the present invention is to provide methods and a device for producing a product section in a web-processing machine, and product sections.

The objects are attained, in accordance with the present invention, by the provision of a printing press with at least one fold former. At least one partial ribbon, having at least one web or partial web, is guided over this fold former. A turning bar is provided in a web path of a partial web and is followed downstream by a plough folding apparatus. A web, or a partial web that passes through the plough folder is combined, at an output of the former assembly and without passing through the fold former, with a partial ribbon containing a web or a partial web which was guided over the fold former.

The benefits to be achieved in accordance with the present invention consist, in particular, that the printing machine can employ an "inline" process to produce a tabloid product having a section which, in the finished product, is equipped with fold-open tabs, or folded extensions, at its upper and/or lower edges, which fold-open tabs, when folded open, extend beyond the height of the rest of the product. This product can be produced by simple procedures using the proposed device, especially "inline", or without the subsequent insertion of a separately produced part, in the area of the uncut webs or ribbons.

In a first embodiment of the present invention, which is advantageous in terms of its structural height, the web ribbon to be folded in on one or two sides is, for example, first diverted out of the machine direction. This diverted web ribbon is then guided over a plough folding apparatus that is arranged to the side of the machine. Finally, before entering the folding unit, this web ribbon is combined, over guide rollers, with one or more ribbons that have already been folded longitudinally. In an embodiment, which is advantageous in terms of its variability, the relevant web ribbon is first guided over a plough folding apparatus in the superstructure, and then is turned 90° in the direction of one or the other side of the machine. Finally, this web ribbon, before entering the folding unit, is combined, over guide rollers, with one or more ribbons that have already been folded longitudinally.

BRIEF DESCRIPTION OF THE DRAWINGS

Preferred embodiments of the present invention are represented in the accompanying set of drawings and will be specified in greater detail in what follows. The drawings show.

DESCRIPTION OF THE PREFERRED EMBODIMENTS

Figure 1:
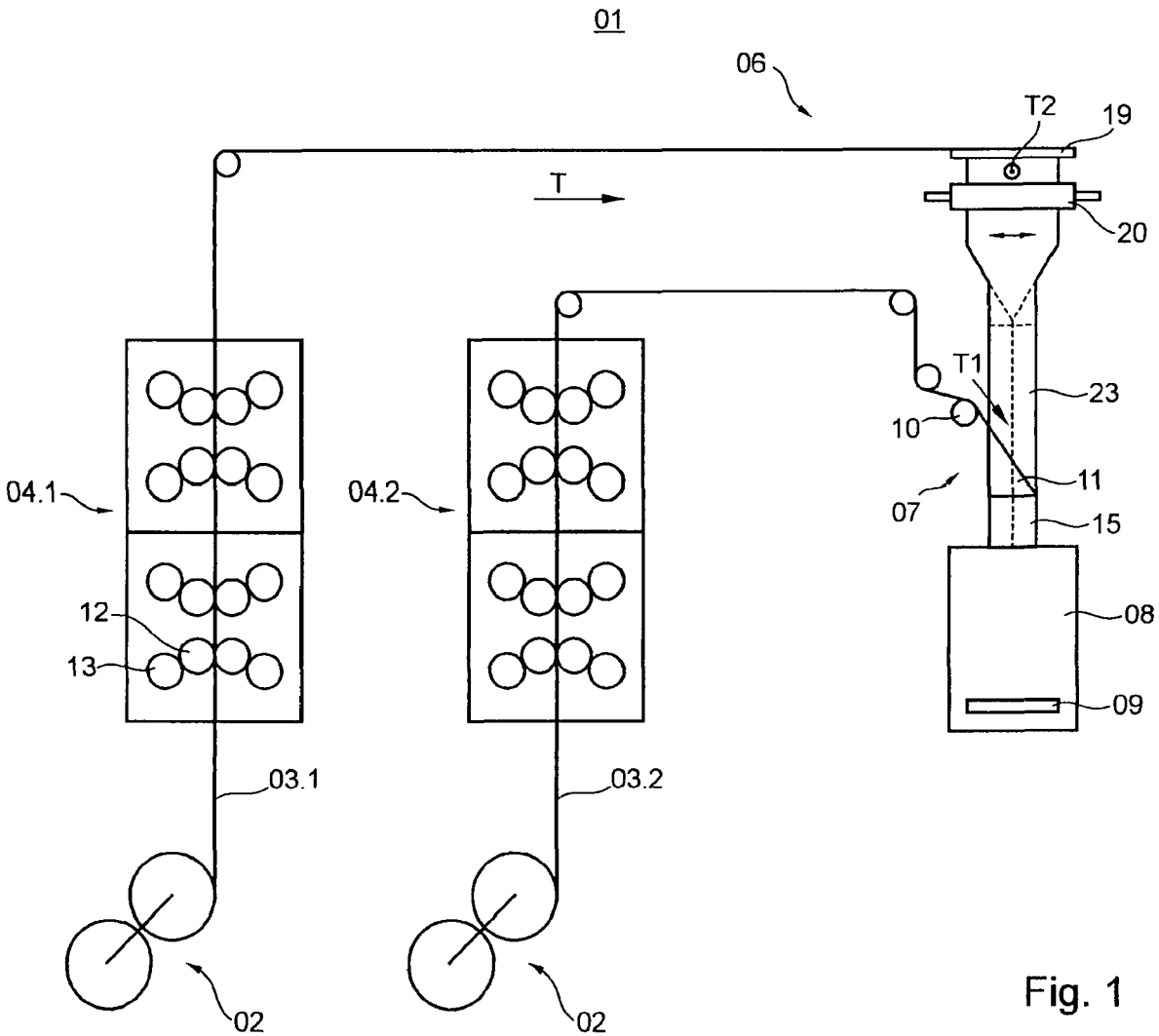
FIG. 1 a schematic side elevation view of a first preferred embodiment of a printing press in accordance with the present invention.
Figure 4:
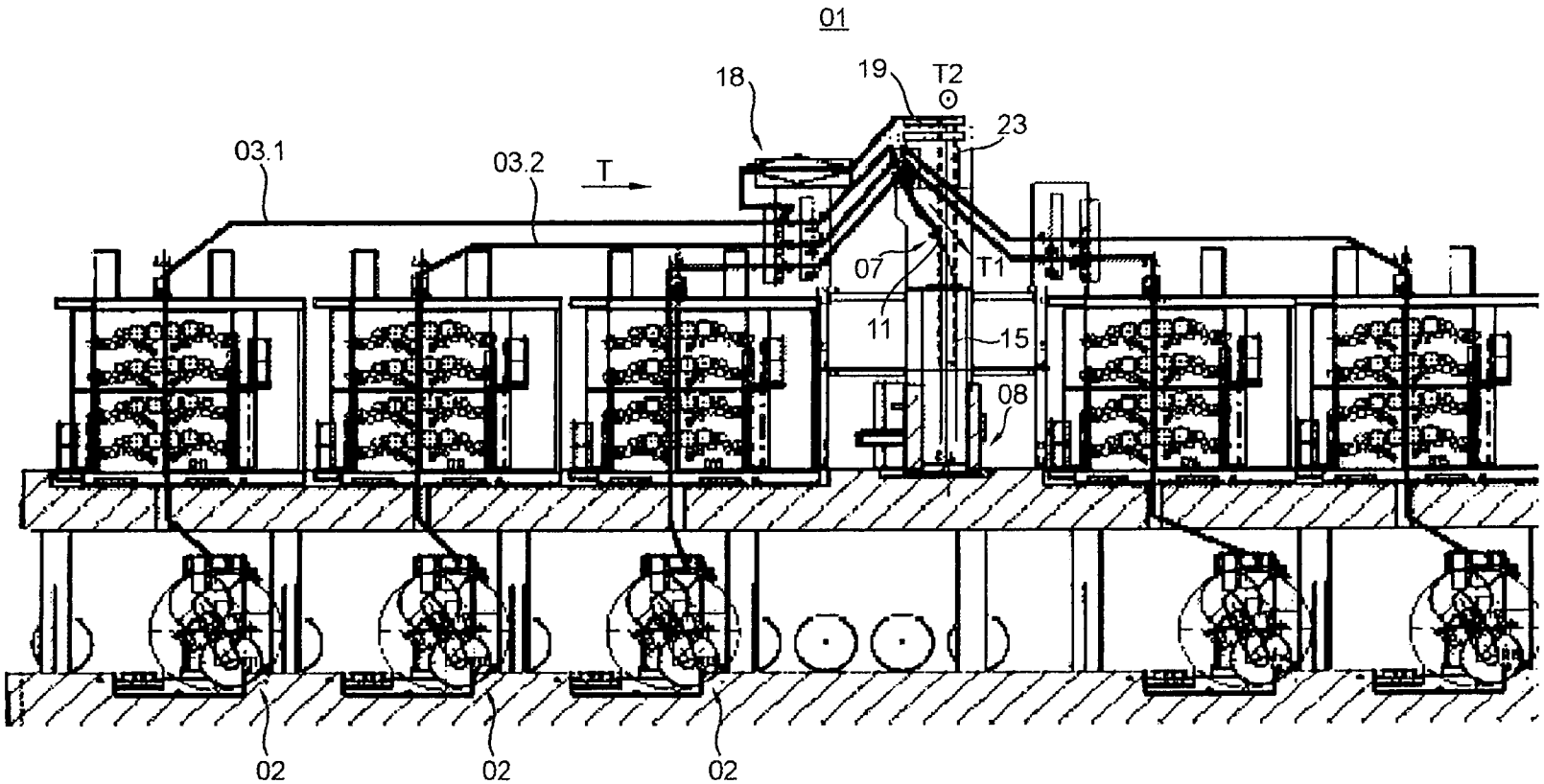
FIG. 4 a schematic side elevation of a second preferred embodiment of a printing press.

A web-processing machine, such as, for example, a printing press 01, and especially a web-fed rotary printing press 01, is schematically illustrated by way of example in FIG. 1 and is illustrated in greater detail in FIG. 4. Printing press 01 has at least one, for example, and preferably has at least two material infeed devices 02, for example one or more reel changers 02, for supplying a web-type material 03, such as, for example, a paper web 03.1; 03.2, which will be shortened here to web 03.1; 03.2, one or more processing stages 04, for example printing units 04.1, 04.2, optionally units of a guiding, turning and/or collating device 06, for example a so-called superstructure 06, a longitudinal folding unit 07, for example a former assembly 07, and an optionally connected further processing stage 08, for example a folder 08 with a product delivery 09.

Figure 2:
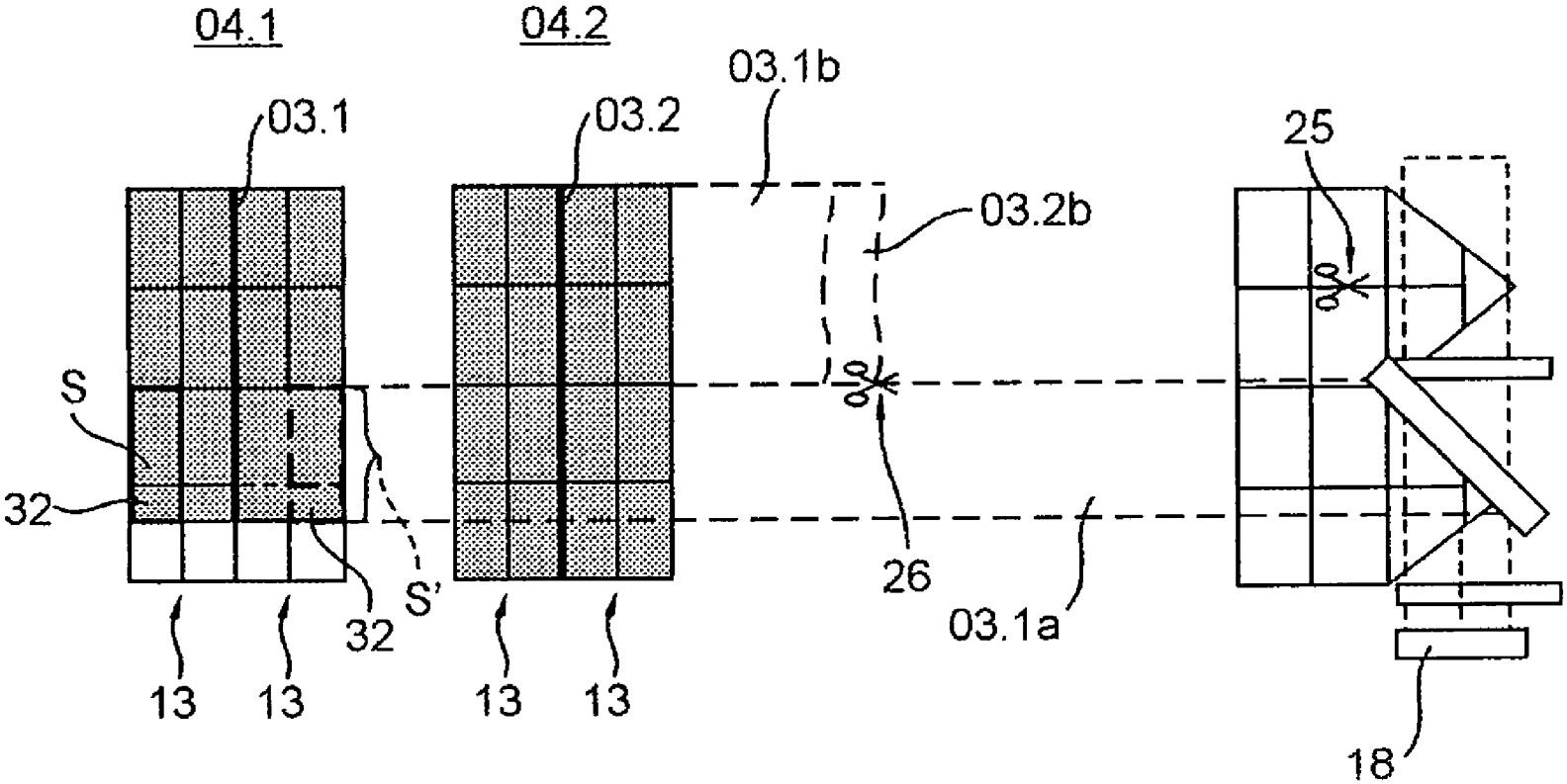
FIG. 2 a schematic top plan view of a printing press in accordance with the present invention, and as shown in FIG. 1.

Depending upon product stage and requirements, the superstructure 06 can typically be embodied with longitudinal cutting devices and/or with longitudinal register devices and/or with turning devices, for example, which are not specifically depicted. These are usable for laterally offsetting and/or for turning downward partial webs 03.1*a*; 03.1*b*; 03.2*b*, as seen in FIG. 2, which are cut longitudinally from the webs 03.1; 03.2. The superstructure may also be provided with drag rollers and/or guide rollers, which are not specifically depicted.

Figure 3:
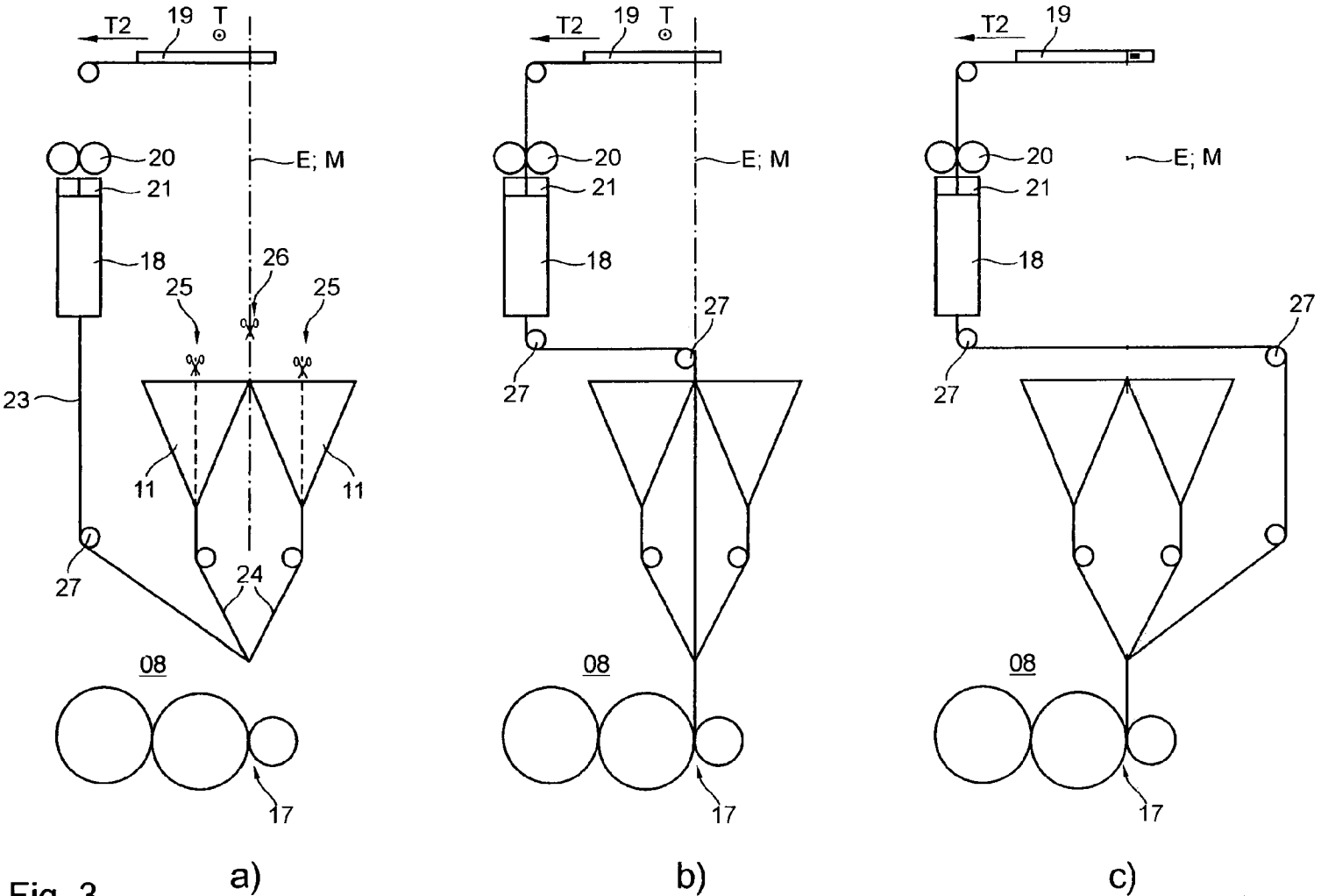
FIG. 3*a*)-FIG. 3*c*) schematic front views of the printing press of FIG. 1.

The former assembly 07 has at least one fold former 11 and preferably has a plurality of fold formers 11.1; 11.2 (11.3), such as, for example, two such fold formers in a first preferred embodiment, or three such fold formers in a second preferred embodiment, which fold formers are arranged side by side, and on which the webs 03.1; 03.2 or their partial webs 03.1*a*; 03.1*b* 03.2*a*; 03.2*b* can be guided, for example in a transport direction T of the printing press 01, viewed linearly. Transport direction T lies within or parallel to a plane E, for example, as may be seen in FIG. 3, which is substantially perpendicular to rotational axes of printing couple cylinders 12; 13 of the printing units 04.1; 04.2. In this case, the plane E, which extends through the center section of the printing couple cylinders 12; 13, for example, can also be identified as machine center plane M, for example, again as seen in FIG. 3. Transport direction T1 on the fold formers 11.1; 11.2 (11.3) also lies in this plane E, or is parallel with it. A roller 10, such as, for example, a drag roller 10, which may be embodied as former intake roller 10 and which is assigned to the fold former 11.1; 11.2 (11.3), extends with its rotational axis substantially parallel to the rotational axes of the printing couple cylinders 12; 13 which are assigned to the same web 03. In the preferred embodiment which is depicted in FIG. 1 to FIG. 3, the longitudinal folding unit or former assembly 07 has a group of two fold formers 11.1; 11.3 arranged side by side at the same level in the machine. Depending upon the width and type of machine, however, only a single fold former, a single group of three or more fold formers, as seen in the second embodiment which is depicted in FIG. 5 through FIG. 8 and FIG. 10, respectively, or two or even three groups stacked one above another, each with one, two, three or even more fold formers 11.*i*, may also be provided.

In the first preferred embodiment of the present invention, which is illustrated in FIG. 1 to 3, a printing press having double-width printing couple cylinders 12; 13 and fold formers 11.1; 11.2 is depicted. In the embodiment depicted in FIG. 4 to 8 and FIG. 10 and FIG. 11, respectively, a printing press with triple-width printing couple cylinders 12; 13, such as, for example, a transfer cylinder 12 and a forme cylinder 13, are represented by way of example. "Double-width" refers to the fact that the maximum effective nominal printing width of the printing couple cylinders 12; 13, when viewed transversely to the web 03.1; 03.2, corresponds to the width of four printed pages in the widest standard format allowed for the machine, in this case horizontal pages in a tabloid format in tabloid configuration, for example. The same can be applied to single-width and to triple-width, with two and six pages arranged side by side, respectively.

Figure 5:
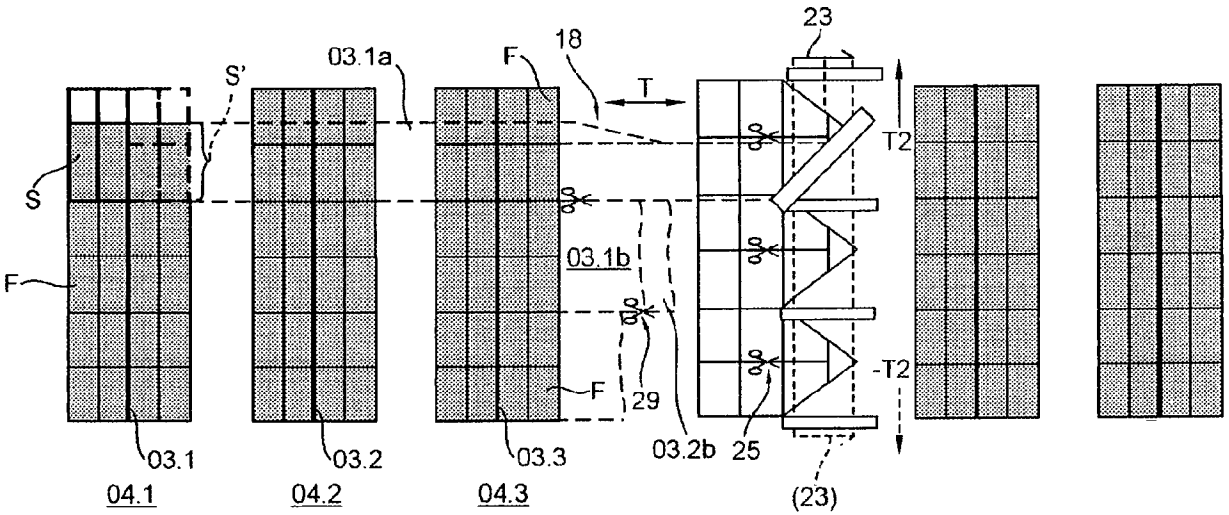
FIG. 5 a schematic top plan view of a printing press as shown in FIG. 4.

In FIG. 2 and FIG. 5, schematic top plan views of the printing presses, as shown in FIG. 1 and FIG. 4, respectively, are schematically illustrated. In a standard production mode, one of the printing units 04.1; 04.2, 04.3, and especially at least the printing unit 04.2 or 04.3 that is closest to the former assembly 07, carries on its forme cylinders 13 the number of print pages in standard format F that corresponds to the nominal width. In FIG. 2 this is four print pages and in FIG. 5 this is six print pages, side by side. In the schematic representations of the printing units, on both sides of the respective web 03.1; 03.2, only the forme cylinders 13 which are loaded with print images are shown. The transfer cylinders 12, which are actually arranged between forme cylinders 13 and web 03.1; 03.2 for offset printing, are not shown here. If all of the printing units 04.*i* and/or their forme cylinders 13, which are producing on the same folding unit 08 at the same time, are loaded with only print pages in the standard format F, customary tabloid products can be produced in standard production mode.

With the configuration of the former assembly 07 comprising two fold formers 11.1; 11.2, as is illustrated in FIG. 2 and FIG. 3, in a first operating mode, such as, for example, in the production of standard products without folded extensions. As will be discussed below, two ribbons with sections that are opened up along the fold spine can be produced in tabloid production on the two fold formers 11.1; 11.2 from one or more webs 03.1; 03.2 having the width of four pages. This can be done after these webs 03.1; 03.2 are cut longitudinally into partial webs in the alignment between the fold formers 11.1; 11.2 by a longitudinal cutting device 26. After they are cut longitudinally in the alignment of the former center by the longitudinal cutting devices 25, one of which is hidden in FIG. 2; these ribbons can then be further processed in the folding unit 08 which is shown in FIG. 1.

Figure 10:
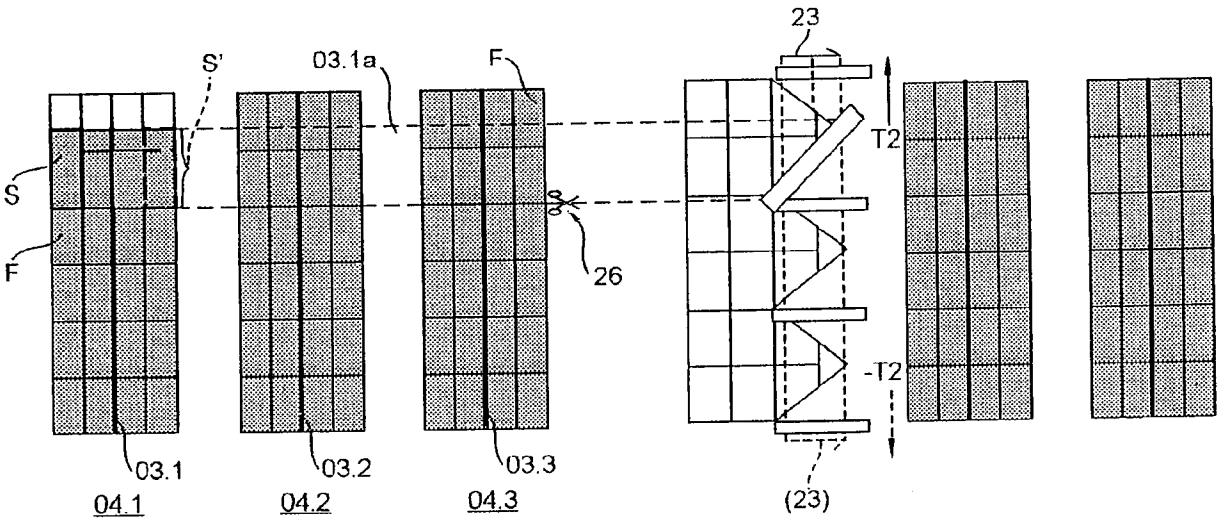
FIG. 10 a schematic top plan view of a printing press as shown in FIG. 4.

With the configuration of the former assembly 07 comprising three fold formers 11.1; 11.2 arranged side by side, as illustrated in FIG. 5 through FIG. 8 and/or FIG. 10, in a first operating mode, such as, for example, in the production of standard products without folded extension and/or without projection; as will be discussed below, three ribbons with sections that are opened up along the fold spine can be produced in tabloid production on the three fold formers 11.1; 11.2 from one or more webs 03.1; 03.2; 03.3 having the width of six pages. This can be done after these webs are cut longitudinally in the alignment between the fold formers 11.1; 11.2 by a longitudinal cutting device 29, and after they are cut longitudinally in the alignment of the former center by the longitudinal cutting devices 25. These ribbons can then be further processed in the folding unit 08.

In this first operating mode, which is referred to as standard production, the forme cylinders 13 of all of the printing units producing on the same folding unit 08 are loaded only with print images for printed pages in the standard format F, and/or all webs 03 that run on the same folding unit 08 are printed only with print images for printed pages in the standard format F. In this case, the number of printed pages that corresponds to the nominal width can be provided side by side, or in the case of partial-width webs, fewer printed pages of this type can be provided side by side. All of the webs 01, which are printed in this manner, are then cut into partial webs 03.1*b*; 03.2*b* which are each one or two pages in width. These partial webs are then guided over the fold formers 11.1; 11.2; 11.3. In the case presented here and involving tabloid production, partial webs 03.1*b*; 03.2*b*, which are two pages in width, are each cut into web ribbons that are one page in width. This is accomplished upstream of the fold former 11.1; 11.2; 11.3.

In contrast to this first operating mode, which is referred to as standard production, in a second operating mode, which is referred to as special production, at least one web 03.1 or one partial web 03.1*a*, and especially one that is printed with printed pages in a special format S; S', and which is wider than a partial web 03.1*b*; 03.2*b* that is printed with printed pages in standard format F, is guided over a longitudinal folding unit 18 which is embodied as a plough folding apparatus 18. This partial web, configured as a partial ribbon 23, at least one side of which has been folded by the plough folding apparatus 18, is combined with at least one partial ribbon 24 that has been guided over a fold former 11.1; 11.2; 11.3 to form a ribbon bundle, before being cross cut into product sections 16 in a cross-cutting device 17, as may be seen in FIG. 3*a*).

Figure 12:
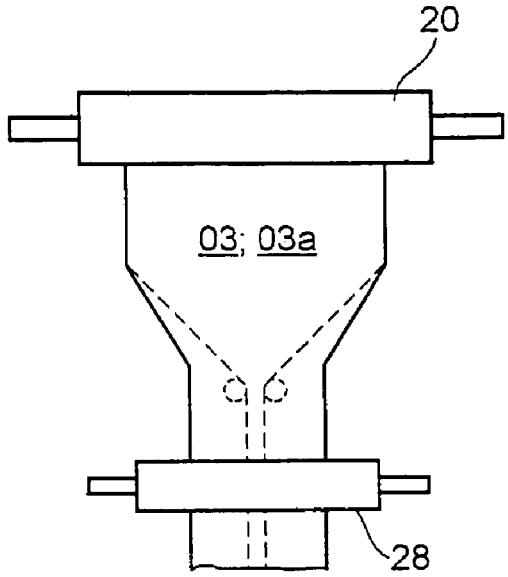
FIG. 12 a schematic illustration of a plough folding apparatus.

In addition to the considerable difference in functionality and in the product that can be produced, a significant difference between the plough folding apparatus 18, as seen in FIG. 12, and the "normal" fold former 11 is that as the ribbon, such as the partial web 03.1*a* and the partial ribbon 23 that is produced, passes through the plough folding apparatus 18, its plane remains in substantially the same orientation. Only one, or both of the edges of the ribbon, such as the partial web 03.1*a* and the partial ribbon 23 are folded onto the center part of the ribbon, which center part of the ribbon continues to travel unchanged. Rotational axes of two folding rollers 28, which are depicted schematically, one in front of another, in FIG. 12, extend in the same direction as the rotational axes of a last roller 20, situated upstream of the plough folding apparatus 18. However, when a web or a partial web is passing through a fold former, the planes of the incoming and outgoing ribbons, and the rotational axes of the last roller upstream and the first roller downstream 20; 28, respectively, rotate opposite one another. The plough folding apparatus 18 is preferably configured to fold in one edge of the web 03 or partial web 03*a*, on both sides or on only one side. The plough folder 18 can be configured to be adjustable, so as to allow one or two edges to be folded in, and/or to allow adjustment of the fold width. In principle, however, the plough folding apparatus 18 can also be modified to produce a so-called "altar fold," a "delta fold" or a "wrapped fold."

In the illustrated embodiments and in accordance with the present invention, the partial web 03.1*a* which is guided over the plough folding apparatus 18 does not pass through any of the fold formers 11.1; 11.2; 11.3 and is thus not folded longitudinally, at least not by any of the fold formers 11.1; 11.2; 11.3. Preferably, the partial web 03.1*a* that is guided over the plough folding apparatus 18 undergoes a 90° change of direction in its web path, upstream or downstream of the plough folding apparatus 18, in its direction of transport T; T2 projecting into the horizontal plane. This change of direction is implemented via an uneven number of turning bars 19, and especially by the use of one such turning bar 19, followed by at least one guide roller 27.

In one variation of the present inventions, in which the width of the partial ribbon 23, which is folded in by the plough folding apparatus 18, corresponds to the width of one printed page in the standard format F or less, the folded partial ribbon 23 can also be guided, without turning, to one of two of the former edges of a fold former 11.1; 11.2; 11.3, together with a strip of a partial web, which has been cut longitudinally and printed in standard format F, and which is not folded in, without forming a longitudinal fold.

The configuration of the plough folding apparatus 18 in the example of FIG. 1 to FIG. 3 of the double-width machine can also be applied to the configuration of a triple-width machine as illustrated in FIG. 4 through FIG. 8, and vice versa.

In this second operating mode, or special production, the forme cylinders 13 of at least one printing unit 04.1 producing on the folding unit 08 are loaded with print images for printed pages in the standard format F and with print images for printed pages in a special format S; S', side by side, and/or the web 03.1 that passes through a printing unit 04.1 of this type is printed with print images for printed pages in standard format F and print images for printed pages in the special format S; S', side by side. The print image for the printed page in special format S; S' can extend, as is represented by dashed lines and as is denoted as S, for example, and as may be seen in FIG. 2, as a continuous print image which is larger than the standard format F, on a printing forme which is wider than the standard format F, such as a panoramic printing forme, or it can be comprised, as represented by continuous lines and denoted as S', of one printed page that corresponds to the standard format F, such as, for example, on a first printing forme, and an adjacent, partial-width print image, such as, for example, on a second printing forme, which is narrower only in relation to the standard format, and as may also be seen in FIG. 2. In the former case, the part of the web 03.1 that corresponds to the partial web 03.1*a*, which is to be folded in downstream by the plough folding apparatus 18, will be or is printed with a continuous print image for the printed page in special format S. In the latter case, the partial web is printed with one printed page that corresponds to the standard format F and one partial-width printed page, side by side. If the partial web 03.1*a* that is to be folded in will be folded in on both sides, with folded edge 26 at the top and the bottom, the former variation is preferred. In this case, the width of two folded edges 26 that are created in the product to be produced, such as, for example tab 26 or folded extension 26, as will be discussed below, must then be taken into account in the printed width of the special format S on both sides of a printed page that corresponds to the printed page in standard format F. The width of the partial web 03.1*a* that will be folded in on both sides will then correspond to this. A part of the web 03.1, that corresponds downstream to a partial web 03.1*b* that will not be folded in, is printed only with print images for printed pages in standard format F, and may optionally be guided onto one of the fold formers 11.1; 11.2; 11.3 after being subjected to longitudinal cutting.

In this second operating mode, the forme cylinders 13 of at least one other printing unit 04.2, which is producing on the same folding unit 08, for example, are loaded only with print images for printed pages in the standard format F. The webs 03.2 that are printed by this printing unit 04.2 are thus printed only with printed pages in the standard format F. In this case, the number of printed pages, either four or six, that corresponds to the nominal width can again be provided side by side, or, in the case, of partial-width webs, fewer printed pages of this type can be provided side by side. The webs 01, which have been printed in this manner, are then all cut into partial webs 03.1*b*; 03.2*b*, each of one or two pages in width, are guided over the fold formers 11.1; 11.2; 11.3, and are combined with the at least one folded web ribbon 23 upstream of the folding unit 08.

In the two preferred embodiments that are illustrated, each partial web 03.1*a*, which is to be folded in, undergoes a change of direction, to a direction crosswise to the machine center plane M, and is folded in along the edge on one or both sides. After this, as a partial ribbon 23, this partial web 03.1*a* is combined, no later than the point of entry into the folding unit 08, with a ribbon 15 from at least one partial web 03.1*b*; 03.2*b* that has been guided over a fold former 11.1; 11.2; 11.3, without itself having been guided over a fold former 11.1; 11.2; 11.3. The change of direction of the travel of this partial web 03.1*a* takes place, in the first embodiment before, and in the second embodiment after, the partial web 03.1*a* passes through the plough folding apparatus.

In the preferred embodiment which is illustrated in FIG. 1 to 3, for the partial web 03.1*a* that will be folded in, the aforementioned 90° change of direction, and the folding in the plough folding apparatus 18, for example on an outer side of the printing press with a substantially vertical direction of web travel, are implemented first.

In the first embodiment of the present invention, which is shown in FIG. 1 to 3, the roller 20 which is situated upstream of the plough folding apparatus 18, and which advantageously is a power-driven drag roller 20, extends with its rotational axis substantially perpendicular to the rotational axis of printing couple cylinders 12; 13 assigned to the same web 03.1 and/or perpendicular to the rotational axis of a former intake roller 10 which is situated directly in front of the fold former 11.1; 11.2. The drag roller 20 is preferably situated in the web path between a turning bar 19 and the plough folding apparatus 18. Preferably, in the web path downstream of the plough folding apparatus 18, and especially at the outlet of the plough folding apparatus 18, the additional roller 28, such as, for example, drag roller 28, and especially a roller pair 28, which presses the fold of the folded section, illustrated in FIG. 12, is provided. The rotational axis/axes of roller 28 or roller pair 28 extends or extend substantially parallel to the drag roller 20 that is situated upstream, and/or substantially parallel to the transverse extension of the web which is entering the plough folding apparatus 18.

As is apparent when FIG. 1 and FIG. 3 are viewed together, a web 03.1 or a partial web 03.1*a*, which initially runs in transport direction T, which transport direction T is symbolized in FIG. 3 by ⊙, is diverted to a new transport direction T2 over at least one turning bar 19, which is inclined 45° or −45° in relation to the transport direction T of an incoming web 03, which projects into the horizontal plane. Transport directions T and T2, which project into the horizontal plane, are then orthogonal to one another. On the web path, downstream of the turning bar 19, the diverted web 03.1 or the diverted partial web 03.1*a* passes the drag roller 20 and is guided over the plough folding apparatus 18. As it passes through the plough folding apparatus 18, at least one side of the web 03.1 or partial web 03.1*a* is folded in on one side or on both sides by specially shaped elements of the plough folding apparatus 18. At least one center section of the ribbon 03.1 or the partial ribbon 03.1*a* continues to travel in transport direction T2, as is schematically illustrated in FIG. 12.

As illustrated in FIG. 3, this ribbon 23, which has the at least one folded edge, can then be combined, over one or more guide rollers 27, either on the side of the machine that has the plough folding apparatus 18 or on the opposite side of the machine, with a ribbon 24 or with multiple ribbons 24 which have been formed from partial webs 03.1*b*; 03.2*a*; 03.2*b* via the fold former or fold formers 11.1; 11.2, as depicted in FIG. 3*a*; FIG. 3*c*. However, in the case of multiple formers, this ribbon 23 with the at least one folded edge can also be guided between the fold formers 11.1; 11.22, as is depicted in FIG. 3*b* or it can be joined with one or more ribbons 24 on the side of the machine opposite the side where the plough folding apparatus 18 is located, as depicted in FIG. 3*c*. Depending upon the orientation of the folding unit 08 downstream which, in this arrangement is toward the left, as seen in FIG. 3, and depending upon the aforementioned chosen ribbon path, the folded ribbon 23 and/or the resulting section, which has been obtained by cross-cutting, and folded ribbon 23 which has at least one folded edge 26, is positioned in the ultimately cross-folded product as the center section, as the section between normal sections, or as the cover section, as may also be seen in FIG. 9. The guide rollers 27 are used to guide the partial ribbon 23 from the plough folder 18 and are oriented with their rotational axes parallel to a transport cylinder and/or to a cutting cylinder of the folding unit 08, which is located downstream.

Figure 6:
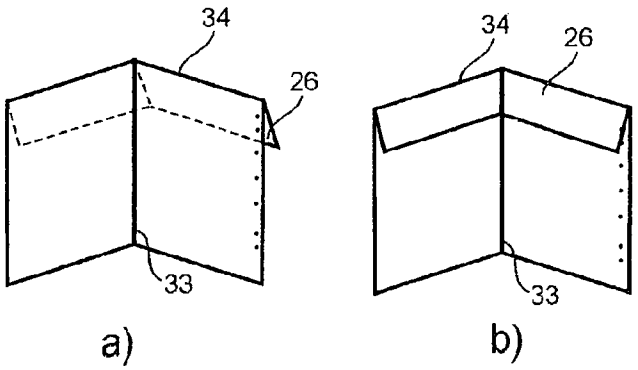
FIG. 6 a front elevation view of the former assembly of FIG. 4 and FIG. 5, and depicting in illustrations a) and b) the folded tab configuration, which configuration is based upon the ribbon path.
Figure 6:
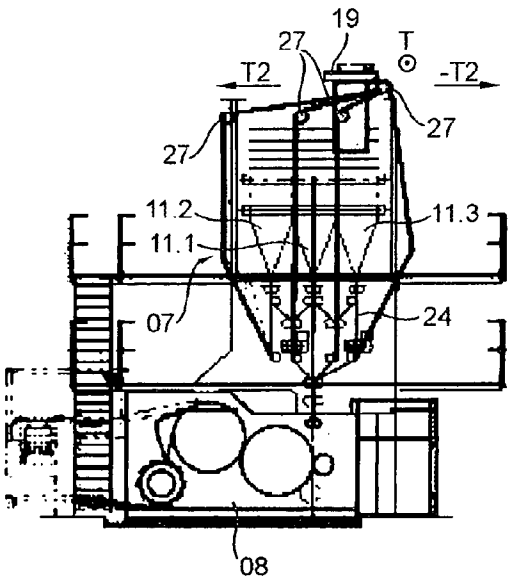

In the embodiment of the present invention that is illustrated in FIG. 4 through FIG. 8, the partial web 03.1*a* that will be folded in is first folded in the plough folding apparatus 18, for example in the superstructure, along a transport direction T which is parallel to the machine center plane M, followed by the aforementioned 90° change of direction, and is then guided over corresponding guide rollers 27 to the desired position in the subsequent ribbon 15, which subsequent ribbon 15 will be further processed in the folding unit 08. Depending upon the path over the guide rollers 27, the folded partial ribbon 23 can be guided on one side or on the other side of the machine without passing through a fold former 11.1; 11.2; 11.3, thereby bypassing the fold former or formers 11.1; 11.2; 11.3, or in the case of multiple fold formers 11.1; 11.2; 11.3, the folded partial ribbon 23 can be guided between two adjacent fold formers 11.1; 11.2; 11.3, and can then be combined with one ribbon 24 or with multiple ribbons 24 that were produced from partial webs 03.1*b*; 03.2*a*; 03.2*b* via the fold formers 11.1; 11.2; 11.3, all as is schematically illustrated in FIG. 6.

In this case, a roller 20, which is optionally situated upstream or downstream of the plough folding apparatus 18, extends, if provided in this first embodiment, with its rotational axis extending substantially parallel to the rotational axis of the printing couple cylinders 12; 13 which are assigned to the same web 03.1, and/or extending parallel to the rotational axis of a former intake roller 10 which is situated directly upstream of the fold former 11.1; 11.2; 11.3. The additional roller 28, such as, for example, drag roller 28, and especially a roller pair 28 which presses the fold of the folded section, as is illustrated in FIG. 12, is preferably provided in the web path downstream of the plough folding apparatus 18, and especially is located at the output of the plough folding apparatus 18, and with its rotational axis or axes extending substantially parallel to the transverse extension of the web which is entering the plough folding apparatus 18.

As is apparent when FIG. 5 and FIG. 6 are viewed together, although the plough folding apparatus 18 is hidden by the turning bar 19 in FIG. 6, a web 03, or a partial web 03*a* which initially travels in transport direction T, which is symbolized in FIG. 6 by ⊙, is first folded along its edge on one side or on both sides by the plough folding apparatus 18, and is then diverted 90° to a new transport direction T2 or −T2 over at least one turning bar 19, which at least one turning bar 19 is inclined at 45° or at −45° in relation to the transport direction T of an incoming web 03, which projects into the horizontal plane. Transport directions T and T2, which project into the horizontal plane, are then orthogonal to one another. In the web path which is downstream of the turning bar 19, the folded web ribbon 23 is then guided around the fold former or formers 11.1; 11.2; 11.3 over at least one guide roller 27, based upon its desired position in the ribbon 15 to be produced, and is then combined with at least one ribbon 24 or with several ribbons 24 which have been produced by the fold former/formers 11.1; 11.2; 11.3 from the partial webs 03.1*b*; 03.2*a*; 03.2*b*. Depending upon the orientation of the folding unit 08 which is situated downstream, in this case, with its delivery toward the left, and/or depending upon the choice of the aforementioned ribbon path, the folded ribbon 23, or the section which results from its cross-cutting and which section has at least one folded edge 26, is positioned in the ultimately cross-folded product as the center section, as a section between normal sections, or as the cover section, as may be seen in FIG. 9. By selecting the orientation of the turning bar 19 and/or based upon the direction of wrap of the web section about the turning bar 19, such as from the bottom up, or vice versa, the position of the tab 26 on the sheet with the tab 26 can be selected. The tab 26 can be situated at the head or at the foot of the page, and can be folded toward the front or toward the back. In the present example of FIG. 5, for example, the left side of the ribbon 03.1*a*, viewed in transport direction T from a plan view, is folded toward the underside of the web by the plough folding apparatus 18, and is then guided from below around the turning bar 19, which is inclined 45° counterclockwise in relation to transport direction T. The partial ribbon 23 is then turned toward the left side of the machine, where it is guided downward over a guide roller 27. The product section with the tab 26 then has the tab at the head of the page on the back side, for example, as may be seen in FIG. 6*a*. Based upon the positioning of the partial ribbon 23 in front of, between, or behind the other ribbons 24 when they are combined, this product section with the at least one is then positioned in the cross-folded product as the center section, an intermediate section or a cover section.

If the turning bar were rotated 90°, i.e., 45° counterclockwise in relation to T, as is the case with the ribbon 23 denoted by dashed lines in FIG. 5, and if the partial ribbon 23 were turned toward the other side of the machine, causing the turning bar to be wrapped in the opposite direction, from the top downward, or causing the web 03.1*a* to be folded upward by the plough folding apparatus 18, the tab 26 in the subsequent product would be situated at the head of the page on the front side of the relevant sheet, for example, as is depicted in FIG. 6*b*. For positioning of this partial ribbon 23 relative to other sheets, the discussion set forth above remains applicable.

Figure 7:
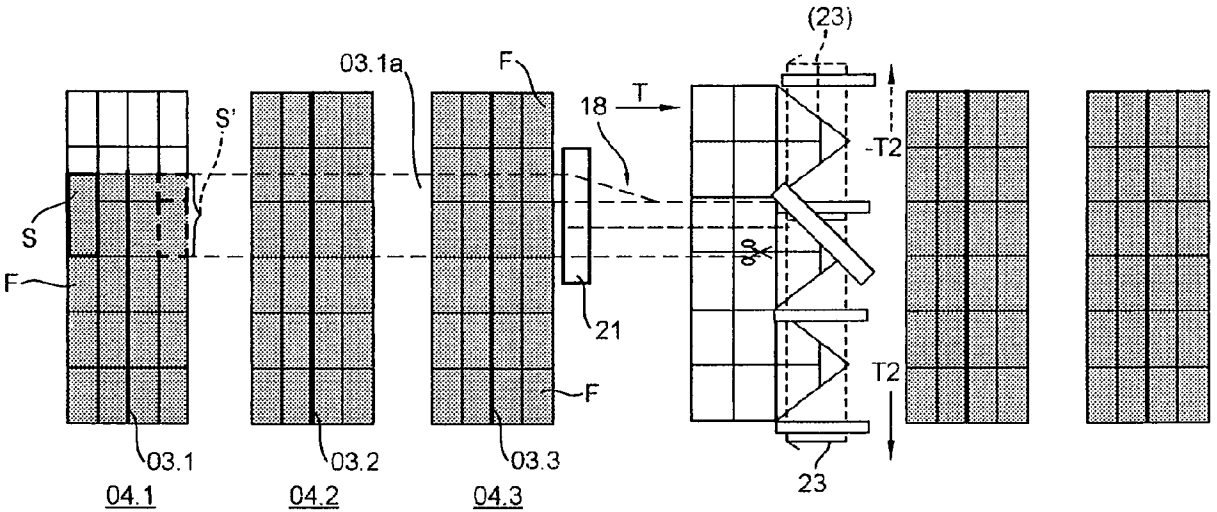
FIG. 7 a schematic top plan view of a printing press as shown in FIG. 4.

In FIG. 7, the other two possibilities for the placement of a tab 26 on a sheet are illustrated. This is also illustrated, by way of example, in a configuration in which, with the printing unit 04.1 having the combined formats F; S, only fewer pages are printed side by side. However, this can also be applied independently to the embodiments of FIGS. 5 and 6, and vice versa. In the present example of FIG. 7, the left side of the ribbon 03.1*a*, as viewed from a plan view in transport direction T, is again folded toward the underside of the web by the plough folding apparatus 18, for example. The now folded web or ribbon 03.1*a* then is guided, from below, around the turning bar 19, and the ribbon section 23 is diverted around the correspondingly oriented turning bar 19, which is now inclined 45° counterclockwise in relation to T, toward the right side of the machine, where it is guided downward over a guide roller 27. The product section, with the tab 26, then has the tab 26 at the foot of the page and situated on the front side, for example as seen in FIG. 8*a*. Again, this section is positioned in front of, between, or behind the other ribbons 24 in the cross-folded product as the center section, as an intermediate section, or as the cover section, based upon the positioning of the partial ribbon 23 when these sections are combined.

If the turning bar is rotated 90° and the partial ribbon 23 is turned toward the other side of the machine, as is the case with the ribbon 23 denoted by the dashed line in FIG. 7, and wherein the turning bar is wrapped in reverse, from the top downward, or the web 03.1*a* is folded toward the top by the plough folding apparatus 18, the resultant tab 26 would be arranged, in the resultant product, at the head of the page on the back side of the relevant sheet, for example, as may be seen in FIG. 8*b*. For positioning of this partial ribbon 23 in relation to other sheets, the discussion set forth above again remains applicable.

In one of the printing units 04.1, the web 03.1 is therefore printed with a printed image which has a projection or a tab 32 at the foot or at the head of the tabloid, in addition to the standard printed page. This web ribbon, the width of which corresponds to a standard page plus the projection or tab 32, is separated as a partial web 03.1*a* downstream of the printing unit 04.1, and the projection or tab 32 is folded over by the plough folding apparatus 18. In the first embodiment, the ribbon 23, with the folded section, is then diverted 90° beforehand, and in the second embodiment it is diverted afterward, over the turning bar 19, which has a large diameter and/or an extended length, for example, as will be discussed below, and is optionally fed to the folding unit 08 on one of the two sides of the machine or between the fold formers 11.1; 11.2; 11.3, together with at least one ribbon 24 that has been guided over a fold former 11.1; 11.2; 11.3. The illustrated tabloid product is thus produced, in which a single paper section has a tab 26 at the foot and/or head of the tabloid pages. The tab 26 can be directed toward the inside or the outside of the tabloid book, and can be attached either in the outer or the inner section or at specific points within the tabloid book.

For all of the embodiments of the present invention, it is advantageous for the turning bar 19 to be wrapped by the partial web 03.1*a* or by the partial ribbon 23 on its web side that does not have the tab 26, assuming that this orientation is feasible and is logical for the relevant product.

Figure 9:
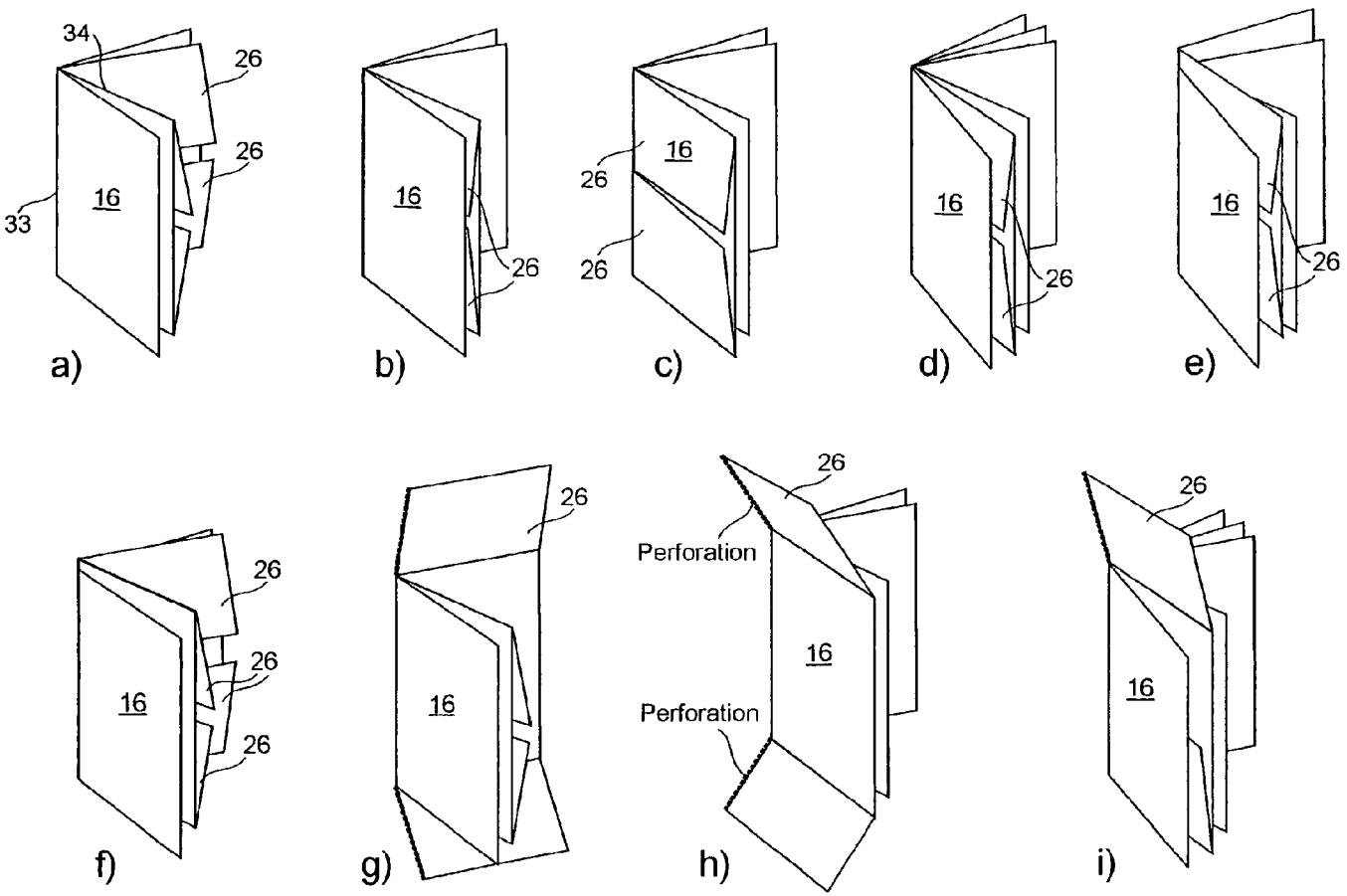
FIGS. 9*a*)-9*i*) Examples of product sections that can be produced with the devices in accordance with the present invention.

Tabs of this type have heretofore been customarily known in magazines or in other tabloid products in which the folded edge for the tab 26 extends parallel to the spine of the book, and the format is altered in terms of its width, but not its height, by folding open a tab 26. However, if tall-format illustrations, such as, for example, an image of a skyscraper or the like, will be included in a tabloid product, it can be particularly advantageous for the user to be able to increase the height of the product format using the presently disclosed tabs 26 or folded extensions 26 and located at the upper and/or lower edge of the page, by folding open such tab or tabs 26 or folded extensions or extensions 26. FIG. 9 shows various product sections which can be produced by cross-cutting the assembled ribbon bundle 15 in a cross-cutting device 17 of the folding unit 08 and by folding the partial web 03.1*a* on both sides.

Figure 8:
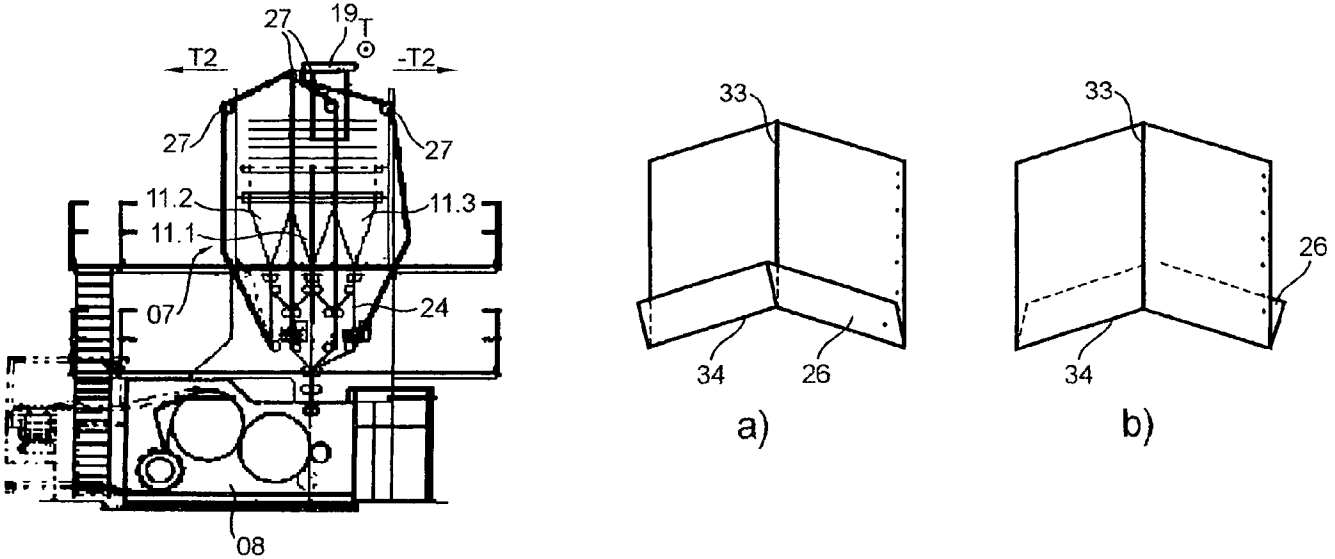
FIG. 8 a front elevation view of the former assembly of FIG. 4 and FIG. 7, and depicting in illustrations a) and b) the folded tab configuration, which configuration is based upon the ribbon path.

In FIG. 9, product ribbons or product sections, which differ from the tabloid ribbon in normal production, are illustrated. The finished product, such as, for example the cut tabloid product, when opened up, has at least one section, configured as a special section, in the area of the upper and/or lower edge, and with at least one tab 26 which extends above the height of the product. One folded edge 34 of the tab 26 extends perpendicular to the spine of the product 33 which spine of the product 33 is a cross-fold, as illustrated in FIG. 6 and FIG. 8. The illustrations in FIG. 9 show the respective product section with a product spine that is already cross folded after cross-cutting and which product section is partially opened here for purposes of illustration. The illustrated sections without tabs 26, referred to as normal sections, are not intended to correspond to the number of normal sections that are actually combined, but are depicted merely to illustrate the positioning of the special section relative to one or more normal sections in the product. The special section may be, for example, a front section, a back section or an intermediate section. In the illustrations in FIG. 9, one normal section can be representative of one or more normal sections stacked one on top of another. The examples in FIG. 9 are illustrated by way of example for the above-described embodiments of the printing press of FIG. 1 to 4 and FIG. 5 to FIG. 8, with partial webs 03.1*a* folded in on both sides, so that the partial web 03.1*a* is provided with tabs arranged at the head and at the foot. However, these illustrations may also be applied accordingly to the above-mentioned embodiments with only one tab 26 at the head or the foot. In the case of a tab 26 at the head or at the foot, the web 03.1*a* to be folded in is guided through the plough folding apparatus 18 such that it is folded in on only one side.

As determined by the guidance of the ribbon 23 having the folded edge, with respect to the other ribbon 24 or ribbons 24, the product section that ultimately is equipped with the fold-open tab 26, or with the folded extension or extensions 26 can be positioned in the finished ribbon bundle 15 or in the finished product section as an outer section, as shown in FIGS. 9*c, h*, between "normal" tabloid sections, as seen in FIGS. 9*a, b, d, e, f, i* or as an inner section, as seen in FIG. 9*g*. Depending upon whether the edges or the edge of the web 03 or partial web 03*a* is/are folded downward or upward by the plough folding apparatus 18, or whether the turning bar 19 is wrapped from the bottom upward or from the top downward, by the web 03 or the partial web 03*a* the orientation of the page that is equipped with the tab 26 can optionally be selected in such a way that the fold-open page in the product is a front page or a back page.

As depicted in FIGS. 9*g, h, i* by the localized enhancements, it can be advantageous for a perforating device 21, and especially for a cross-perforating device, to be provided on the web path of the plough folding apparatus 18. Such a perforating device 21 preferably cross-perforates the web 03 or the partial web 03*a* not over its entire width, but only in sections, and especially in the area of the edges that will be folded down. Thus, for example, if the two pages, which have been produced from the same web section downstream by cross-folding, are not arranged at the center of the product as a panoramic page, the folded tab 26 can still be easily separated at the side and can be folded open.

In a further embodiment of the present invention, as illustrated by way of example in FIG. 9*e* and FIG. 9*f*, it can also be provided that the section that has the folded edge or folded extension 26 is arranged, or can be produced with greater dimensions, such that this section with the folded edge or folded extension 26 projects beyond the finished product at its upper or lower side. This special section can thus be easily identified or, if applicable, can be easily removed. A section of this type is also called a "pop-up." The part of this "pop-up" which projects beyond the dimensions of the normal sections can be printed with information, for example with information regarding its content. Production can be implemented either by making the plough folding apparatus 18 movable in, or opposite to the transport direction T, as indicated in FIG. 1 by dashed arrows, or by making the turning bar 19 movable crosswise to and/or in the transport direction T, as in FIG. 5 or 7, and thereby displacing the position of the ribbon 23 relative to the ribbon 24 or to the ribbon bundle 15. Alternatively, however, a correspondingly wider initial partial web 03*a* can also be chosen for formation of the ribbon 23, and/or one side can be folded, such as, for example by shortening of the folded extension 26, such that the folded edge of the corresponding folded extension 26 projects beyond the product.

In one advantageous embodiment and/or operating situation in accordance with the present invention, which may be considered as a further improvement on the above-mentioned, or, if applicable, which may be viewed alone, a product that contains a pop-up section can be produced using the printing press, without great expense. In this preferred embodiment, the partial web 03.1*a* which bears the printed image that is wider than the normal format is guided over the turning bar 19 and the guide roller or rollers 27, without passing through an optionally provided plough folding apparatus 18 so that it is guided without an edge of the web being folded in. This partial ribbon 23, the width of which corresponds to a special format, is combined with one or more ribbons 24 which have been guided over fold formers 11.1; 11.2; 11.3, and the width of which corresponds to the narrower format F. To load the forme cylinder 13 with print images in the standard format F and with print images in both the standard format F and in the wider special format S; S', the aforementioned should be applied. FIG. 11*a*) shows, by way of example, a product with an inner section which is embodied as a pop-up, and which is produced by combining this partial ribbon 23 with the other partial ribbons 24 as the section of the ribbon 15 next to the transport cylinder 31 of the folding unit 08. FIG. 11*b*), by way of example, shows a product with an intermediate section which is embodied as a pop-up and which is produced by positioning this partial ribbon 23 between two of the other partial ribbons 24, which have been guided over the fold formers 11.1; 11.2; 11.3 and which have the standard format F. The section of the finished product, which is embodied as a pop-up, thus has a projection 32 or a tab 32 that is not folded in at its head and/or its foot, in addition to also having a "normal" printed page in standard format.

Figure 11:
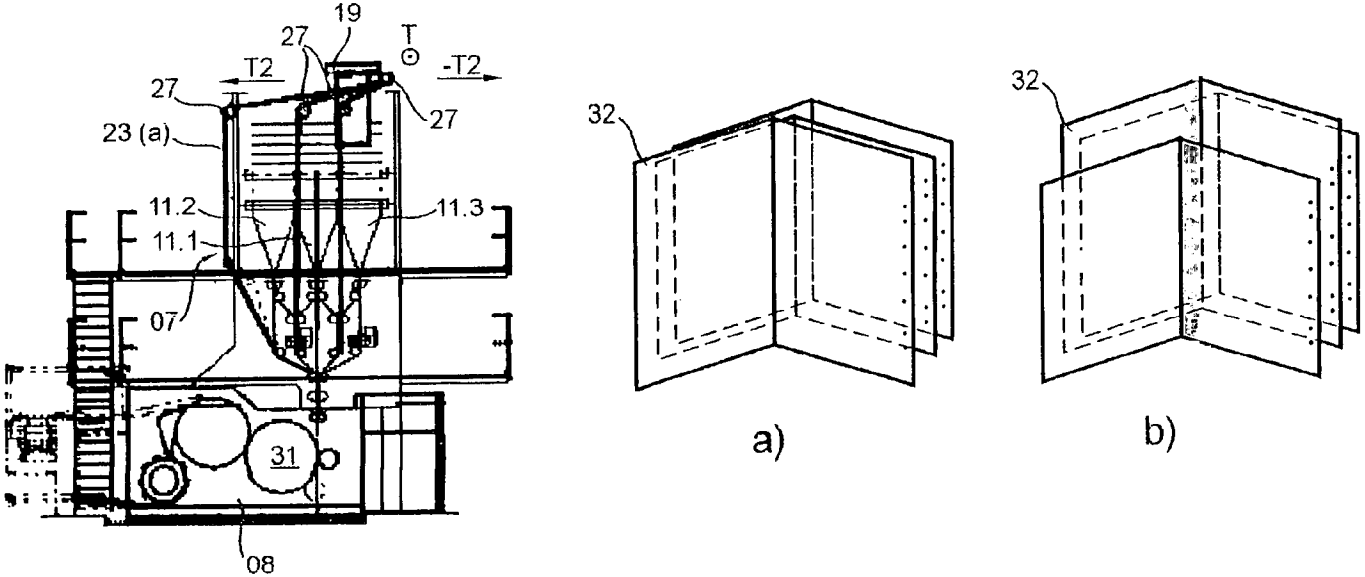
FIG. 11 a front elevation view of the former assembly of FIG. 4 and FIG. 10, with illustrations a) and b) of the folded tab configuration, which configuration is based upon the ribbon path.

In the one printing unit 04.1, a web 03.1 is printed. The printed image of this web 03.1 has a printed image that extends beyond the standard format F at the head or the foot, in a special format S; S', thereby forming the projection 32. This web ribbon, the width of which corresponds to a standard page plus the projection 32, is separated as partial web 03.1*a* downstream of the printing unit 03.1, and is diverted 90° over the turning bar 19, which turning bar 19 has a large diameter and/or has an extended length, for example, as will be discussed below. This web ribbon is then fed to the folding unit 08, optionally on one of the two sides of the machine or between fold formers 11.1; 11.2; 11.3. It is fed to the folding unit 08 together with at least one ribbon 24 that has been guided over a fold former 11.1; 11.2; 11.3. Thus, tabloid products, examples of which are illustrated in FIG. 11, are produced, in which a single paper section has the projection 32, which can be located, for example, at the head of the tabloid pages. This projection 32 can be positioned in either the outer section or in the inner section, or at specific locations within the tabloid book. The projection 32 is particularly conspicuous in the finished newspaper product due to its projected position. It can be printed with a special advertisement or with a special headline, for example.

The turning bar 19 is preferably embodied so as to be movable and positionable crosswise to transport direction T, and thus crosswise to the direction of travel of the incoming web 03.1*a*. Turning bar 19 can advantageously be moved at least the width of one web page to be folded in, or in other words by the height of the desired tab 26, such as, for example, by at least one-fourth of the width of a printed page in standard format. In one advantageous further improvement, the turning bar 19 can be moved so as to be placed in alignment with all of the partial webs 03.1; 03.2 that are two pages in width.

A further advantageous embodiment of the turning bar 19 in accordance with the present invention is configured, at least in its longitudinal section which cooperates with the partial web 03.1*a* to be diverted, as an air-blown or blowable turning bar having air outlet openings, with its effective turning length, which projects over the width of the incoming web, being at least 1.25 times, and preferably being at least 1.5 times, the standard format F to be printed in the machine. For a double-width machine, for example, this corresponds to at least 1.25 or 1.5 times the one-fourth part of the maximum usable barrel length of the forme cylinder 13, and for a triple-width machine, for example, this corresponds to at least 1.25 or 1.5 times the one-sixth part of the maximum usable barrel length of the forme cylinder 13.

Figure 13:
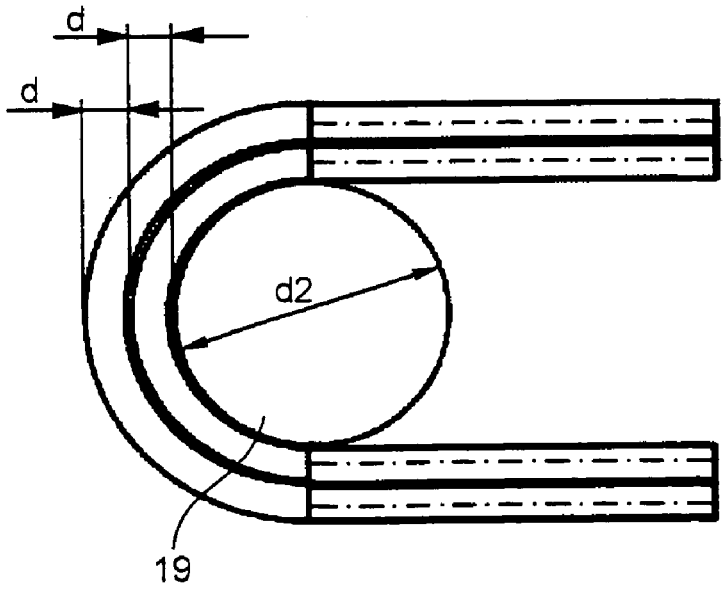
FIG. 13 a schematic cross-sectional illustration of a wrapped turning bar.

Because webs or partial webs 03.1*a* with folded sections can also experience a decreased quality or fold formation, which may be caused as they are guided over the turning bar 19, in one advantageous embodiment, a turning bar 19 of comparatively large diameter d2, such as, for example, having a diameter d2 of at least 100 mm, and preferably of at least 110 mm, is provided, as depicted in FIG. 13.

With the larger diameter d2, the theoretical difference in length, which is based upon a section thickness and the wrap-around angle $\pi/2$, and which is equal in the two bar diameters, is distributed over a greater path length. Thus, with the larger diameter d2 for turning bar 19, the difference in tensile stress between the outer section and the inner section decreases, thereby also decreasing the risk of fold formation.

For all embodiments, of the present invention a stitcher, and especially a cross-stitcher, can be arranged in one or more of the ribbon paths of the ribbons 24. Such a stitcher may also be located in the ribbon path of the ribbon bundle 15.

The webs 03.1; 03.2; 03.3 that can be processed to produce the product section 16 can be printed in advance in the printing units 04 using either the coldset process or the heatset process. In the latter case, for example, a dryer, which is not specifically shown here, is arranged in the web path downstream of the relevant printing unit 04 which is used to print the web 03 in the heatset process. Depending upon the configuration of the printing press 01, both the inner sections and the outer cover section can be produced from webs 03 which have been printed in the coldset process or in the heatset process, or from webs 03 which have been printed in the coldset and the heatset processes combined. The printing press 01 will then have no dryer, one dryer, or more dryers, depending upon its individual requirements.

While preferred embodiments of a method and a device for producing a product section in a web processing machine, and a product section so produced have been set forth fully and completely hereinabove, it will be apparent to one of skill in the art that various changes in, for example, the specific structure of the printing units, the drives for the printing units, the type of web being printed, and the like could be made without departing from the true spirit and scope of the present invention which is accordingly to be limited only by the appended claims.

What is claimed is:

1. A method for producing a product section in a printing press including:

providing one of a first web and a first partial web;

providing at least one fold former in said printing press;

guiding said first one of said first web and said first partial web over said at least one fold former and forming a first partial ribbon;

providing one of a second web and a second partial web;

providing a plough folding apparatus in said printing press;

guiding said one of said second web and said second partial web over said plough folding apparatus;

using said plough folding apparatus and folding at least one side of said one of said second web and said second partial web in, and forming a second partial ribbon;

providing an uneven number of turning bars and directing said second partial ribbon over said turning bars;

providing at least one guide roller in said printing press;

combining said first partial ribbon, after being guided over said at least one fold former, with said second partial ribbon guided by said guide roller, and without being guided by said at least one fold former, and forming a ribbon bundle;

providing a cross-cutting device; and using said cross-cutting device and cross-cutting said ribbon bundle into said product sections.

2. The method of claim 1 wherein said second partial web to be folded is first guided over said plough folding apparatus and then over said uneven number of turning bars, preferably which uneven number is one.

3. A method for producing a product section in a printing press including:

providing a first partial web printed with printed pages having a width of a first format;

providing at least one fold former;

guiding said first printed web over said at least one fold former;

providing a second partial web printed in tabloid configuration and having one of a one and two part printed page in a second format, said second format being larger, by a projection, than said first format;

providing an uneven number of turning bars;

guiding said second partial web, printed in said second, larger format, over said uneven number of turning bars and without passing through said fold former;

providing at least one guide roller;

locating said at least one guide roller downstream, in a direction of web travel, of said uneven number of turning bars;

directing said second partial web over said at least one guide roller and combining said second partial web with said first partial web which has been guided over said at least one fold former and which contains said printed pages in said first format, smaller than said second format, and forming a ribbon bundle;

providing a cross-cutting device; and cross-cutting said ribbon bundle using said cross-cutting device after combining said first partial web and said second partial web and forming said product sections.

4. The method of claim 3 further including providing a plough folding apparatus and using said plough folding apparatus for folding said projection of said second partial web.

5. The method of claim 4 including printing said partial web to be guided over said plough folding apparatus upstream with a one on two part printed page in said second format which overall is larger than said first format and is less than double said first format, in tabloid configuration, with a longitudinal side traveling in a direction of a cylinder axis in said printing press.

6. The method of claim 5 further including providing a printing couple cylinder having said cylinder axis and transferring said second format printed page to said web, using said printing couple cylinder, as a continuous printed image, arranged asymmetrically on a printing forme and having a printing forme width corresponding to two printed pages having said first format.

7. The method of claim 5 further including providing a printing couple cylinder having said cylinder axis and transferring said second format printed page to said web using said printing couple cylinder as a divided printed image with a first part on a first printing forme having a first printing forme width corresponding to a printed page in said first format and having a second part, which is smaller than said first printed page, and arranged asymmetrically on a second printing forme, said second printing forme having a second printing forme width corresponding to one printed page in said first format.

8. The method of claim 4 further including producing said second partial web to be guided over said plough folding apparatus by providing a printing couple cylinder having a longitudinal direction and by longitudinally cutting a web which has been printed by said printing couple cylinder with printed pages in said first format side by side into said first partial web and forming said second partial web including said first partial web and said at least one printed page in said second format which is longer, as viewed in said longitudinal direction of said printing couple cylinder.

9. The method of claim 4 including providing said second partial web, which has been folded having said projection by using said plough folding apparatus, having a longitudinal fold which is eccentric in relation to said second partial web entering said plough folder for folding in at least one edge of said second partial web.

10. The method of claim 4 wherein said second partial web to be folded is first guided over said uneven number of turning bars, preferably which uneven number is one, and is then guided over said plough folding apparatus.

11. The method of claim 3 including providing a cylinder axis in said printing press and printing said partial web to be guided over said fold former with at least two horizontal printed pages in said first format in tabloid configuration and with a longitudinal side travelling in a direction of said cylinder axis.

12. The method of claim 11 further including opening said first partial web lengthwise in an area of a fold spine one of before and after passing through said fold former.

13. A device for producing a product section in a printing press comprising:

at least one printing unit;

at least one former assembly including at least one fold former, said at least one former assembly forming at least one first partial ribbon having one of a first web and a first partial web, said at least one first partial ribbon being guided over said fold former;

at least one plough folding apparatus and at least one turning bar located in a web path of travel of a second partial ribbon including one of a second web and a second partial web which passes through said plough folding apparatus; and an output of said former assembly, said first partial ribbon, which is guiding over said fold former, and said second partial ribbon, which passes through said plough folding apparatus without passing through a fold former, being combined at said outlet of said former assembly to form a ribbon bundle.

14. The device of claim 13 further including a cylinder axis of said at least one printing unit, said first partial ribbon, which is guided over said fold former, is printed in said at least one printing unit upstream of said at least one former assembly with at least two horizontal printed pages in a first format in tabloid configuration and with a longitudinal side running in a direction of said cylinder axis.

15. The device of claim 14 wherein said second partial ribbon which passes through said plough folding assembly, is printed upstream with one of a one part and a two part printed page having a second format which is larger than said first format in tabloid configuration and with a longitudinal side running in a direction of said cylinder axis.

16. The device of claim 13 further including a forme cylinder in said at least one printing unit and being loaded with print masters having print images in a first format side by side and with print masters having print images of at least one single or multi-part print image in a second format larger overall than said first format.

17. The device of claim 13 further including a perforating device located before, in a direction of web travel, said plough folding apparatus in said second web path of travel, said perforating device being usable to cross-perforate said second partial ribbon to be folded by said plough folding apparatus at least in sections and especially in areas of edges that are folded down.

18. The device of claim 13 wherein said at least one former assembly includes a plurality of said fold formers located side by side, and further including a plurality of guide rollers located after, in a direction of web travel, said at least one plough folding apparatus, said plurality of guide rollers being selectively usable to guide said second partial ribbon to a selected side of said first partial ribbon which has been guided over said fold formers.

19. The device of claim 13 wherein said at least one turning bar is movable crosswise to a direction of web travel.

20. The device of claim 13 wherein said at least one turning bar has an effective length, projected over a width of an incoming web, which effective length is at least 1.25 times a length of a standard printed page in a format to be printed by said at least one printing unit.

21. The device of claim 13 wherein said at least one turning bar has a diameter of at least 100 mm in an area in contact with said second partial ribbon.

22. The device of claim 13 wherein said at least one plough folding apparatus is situated before said at least one turning bar in a direction of web travel.

23. The device of claim 13 wherein said at least one turning bar is situated before said at least one plough folding apparatus in a direction of web travel.

24. The device of claim 13 wherein said at least one plough folding apparatus is in said second path of travel of said second partial ribbon and upstream of said at least one turning bar.

* * * * *